United States Patent [19]

Hugues et al.

[11] Patent Number: 4,581,006

[45] Date of Patent: Apr. 8, 1986

[54] METHOD OF AND MEANS FOR POSITIONING SLIDERS ON ZIPPERS FOR RECLOSABLE BAGS

[75] Inventors: Gilbert P. J. Hugues, Ville D'Avray; Norbert A. Heyka, Auneuil, both of France

[73] Assignee: Minigrip, Incorporated, Orangeburg, N.Y.

[21] Appl. No.: 528,265

[22] Filed: Aug. 31, 1983

[30] Foreign Application Priority Data

Aug. 31, 1982 [FR] France ..... 82 14887

[51] Int. Cl.[4] ..... B31B 1/90; B31B 23/74

[52] U.S. Cl. ..... 493/213; 493/927; 29/768

[58] Field of Search ..... 493/213, 214, 215, 338, 493/380, 923, 927, 962, 963; 29/768, 705, 409; 425/814; 24/418, 419

[56] References Cited

U.S. PATENT DOCUMENTS

| | | | |
|---|---|---|---|
| 3,116,544 | 1/1964 | Fisher | 29/768 |
| 3,127,670 | 4/1964 | Bruning | 29/408 |
| 3,426,396 | 2/1969 | Laguerre | 24/427 |
| 3,701,191 | 10/1972 | Laguerre | 29/768 |

FOREIGN PATENT DOCUMENTS

| | | | |
|---|---|---|---|
| 2085519 | 4/1982 | United Kingdom | 493/213 |

*Primary Examiner*—Francis S. Husar
*Assistant Examiner*—William E. Terrell
*Attorney, Agent, or Firm*—Hill, Van Santen, Steadman & Simpson

[57] ABSTRACT

A device and method for repositioning sliders on profiled resiliently flexible zipper on bag sections of bag making material travelling along a manufacturing path. The device may comprise a frame, two movable rollers cooperatively opposed to one another mounted on free ends of arms which are pivoted and adapted for moving the rollers toward and away from one another. When the rollers are in close adjacency they are adapted to restrain the sliders for a predetermined interval while the zipper travels on with the bag making material whereby to reposition the slider properly with respect to transverse bag side sealing of the bag sections. The rollers are operable to shift the sliders in opposite directions along the zipper in the cyclical operation of the associated apparatus, whereby to test proper functioning of the sliders. The rollers are also adapted to function selectively as zipper closing rollers, or to leave the zipper open while functioning to reposition the sliders on the bag section portions of the zipper.

16 Claims, 5 Drawing Figures

METHOD OF AND MEANS FOR POSITIONING SLIDERS ON ZIPPERS FOR RECLOSABLE BAGS

The present invention relates generally to an apparatus and method for the fabrication of plastic bags. Such bags comprise two superimposed sheets or panels joined along their side edges, the bottoms of the bags remaining open or being closed by a joining or folding line. The bags are equipped with profiled reclosable fastener elements extending along the bag mouths and capable of being joined by elastic deformation by pressure in the sliding action of a slide device commonly referred to as "slider". The reclosable fasteners of this type are generally referred to as "zippers".

The apparatus with which the present invention is especially useful comprises, inter alia, in a known arrangement, an extruder which produces the sheet material for the bag walls and below which may be provided means for automatically placing the sliders in operating position on the separable fastener elements of the zipper means along the longitudinal edges of the superimposed sheets of bag making material. Thereafter, during cyclical stops in the movement of the bag making material, means are operative for sealing the material along transverse separation lines for providing the side edges of the bags.

The reclosable zipper conveniently enables the user to open or close the bag in a repeated manner by a simple displacement of the slider along the fastener elements of the zipper. At each opposite extremity along the length of the zipper, the slider is stopped at the upper ends of the side seals of the bag where the two profile elements of the zipper are flattened and sealed together.

The profiled separable zipper fastener elements may be extruded at the same time as the bag making sheets so as to constitute an integral part of the sheets, or the fastener elements may be separately prepared and continuously brought into assembled relation with the respective longitudinal edges of the sheets and fused or cemented thereto.

A suitable device, such as, for example, that which is the subject of French Patent application in the name of the same assignee as the assignee of the present application and filed on Oct. 14, 1980 under the number 80 21974, published Apr. 16, 1982 as No. 2 491 742, automatically effects applying of the sliders in an operational position on the profile fastener elements on each bag width. This automatic applying of the sliders is effected at the desired cyclical rate and occurs above the station at which the slider equipped bag material is transversely sealed and cut to divide the same into bag sections.

A problem is presented in respect to the positioning of each slider relative to the particular length of zipper fastener on each bag section, because the apparatus must be capable of supplying bags of selectively variable widths. In order to prevent any of the sliders from being applied at location on the material where the side seals are to be made and which might cause a malfunction, it is generally necessary on setting up from one bag width to a different bag width to reposition the means for applying the sliders in order to change the distance which separates the slider applying means from the sealing and blade or bar means and to do this with the precision necessary to accommodate the proper multiple of the width of the bags. Otherwise the sliders may be positioned in locations relative to the width of the bags which may become shifted progressively toward one of the side edges of the bag sections which would result inevitably in a malfunction.

One of the objects of the present invention is to avoid the disadvantage which arises from having to reposition, more or less frequently the relatively heavy and cumbersome equipment of the means for applying the sliders, but to permit such means to remain in a fix position in the apparatus while at the same time automatically and in complete security preventing a risk of any malfunction.

For the attainment of this object in apparatus of the general type indicated hereinabove, the present invention provides, between the means for applying the sliders and the sealing and severing station, an automatic means for positioning the sliders on the zipper of each bag section at a predetermined spacing from the location thereon where the transverse sealing and separation joint is to be effected for any desired width of bag. This avoids any risk of a slider applied by the applying means from being misplaced on the location at which the transverse sealing joinder is to be effected, and thus avoids any risk of malfunction developing from the sealing and severing means crushing a slider.

Accordingly, the means for applying the sliders can be mounted in a fixed location in the apparatus, particular where movement of the bag making material in the apparatus is in a generally vertical direction. Such an arrangement is particularly advantageous because it renders the means for applying the sliders simpler and more efficient, by virtue of the sliders being adapted to be fed by simple gravity in a generally vertical channel.

It is thus another object of the invention to provide in bag making apparatus an arrangement which will permit locating slide applying means in a stationary position along a generally vertical path of movement of the bag making material to receive the sliders.

In keeping with the general objects of the invention, the present invention provides for efficiently controlling the position of the slider on bag width sections of zipper-equipped bag making material in the interim between a slider applying station and a bag section sealing and separating station and with the slider controlled to avoid interference with or damaged by the means by which the separating seals are applied across the material.

For attaining these improved results, the invention provides a device comprising a frame providing a passageway for movement of slider equipped zipper means along the longitudinal edges of confronting bag wall sheet material, there being slider-controlling rollers located in the passageway for movement of the zipper portion of the bag making material longitudinally between the rollers being mounted at the free ends of respective pivotal arms by which the rollers are activated to come together at the downstream side of sliders mounted on the zipper means for momentarily impeding movement of each slider on the longitudinally travelling bag making material for thereby effecting a longitudinal displacement or shifting of the successive sliders along the zipper in a predetermined range, whereupon the rollers are separated in order to free the successive sliders for onward travel with the zipper means. Thereby, the sliders are adapted to be efficiently automatically oriented to proper position on the respective successive bag sections of the material, in a positive, advantageous manner.

This device and method are also advantageous in that either open or closed bags are adapted to be processed, and in the shifting of the sliders effected along the zipper means, each slider is, in effect, tested for proper operation along the zipper.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

As already alluded to hereinbefore, the present invention is particularly adapted for use in the manufacture of plastic bags comprising sheet material which provides two opposite walls joined as by means of heat seals along side edges of the bag, there being a folded joint or another heat seal along the bottom of the bags unless the bags are to have open bottoms for filling the same. At the mouth ends of the bags two profiled zipper elements are provided which carry a slider by which the bag can be opened and closed by acting on the elastically deformable profiled elements of the zipper.

Figure 1:
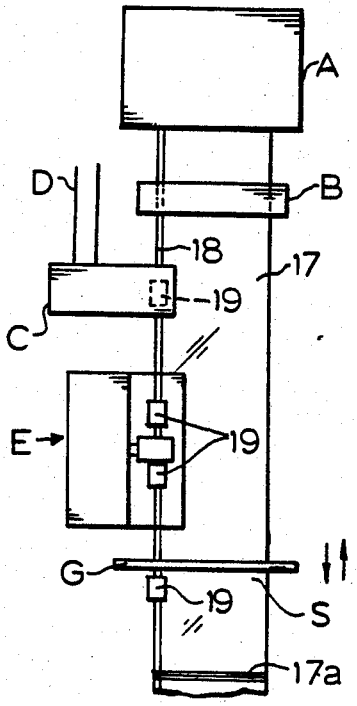
FIG. 1 is a schematic illustration of bag making apparatus embodying the invention.

By way of example, referring to FIG. 1, the bags are adapted to be continuously made at a rapid cyclical rate by extruding the bag making material from an extruder A in preferably a downward direction to provide bag side wall sheet material 17 and which may be equipped as extruded with zipper profile means 18, or to which the profile means may be applied and secured after the bag wall sheet or film material has been extruded. Downstream adjacent to the extruder A the bag making material may be treated in a treating zone B for chilling and setting the plastic material so that it can be further handled. Then in the onward travel of the bag making material, sliders 19 are applied to the profile zipper means 18 by means of an applicator C which is adapted to be supplied with a continuous series of the sliders through a preferably vertically extending channel D. Downstream from the slider applicator a slider orientation controlling device E, which is the principal concept of the present invention, controls the proper position of the successive sliders 19 carried by the zipper means 18 for each bag section into which the bag making material 17, 18 is then divided by a sealing means G which may be of the well known reciprocating type adapted to not only provide tear type heat seals 17*a* across the bag making material but also to advance the bag material by bag width increments, as indicated by the directional arrows. Each bag section S delineated by the bag side seals 17*a* will thus have the slider 19 properly oriented thereon to avoid any interference with or damage by the sealing and advancing device G.

Figure 2:
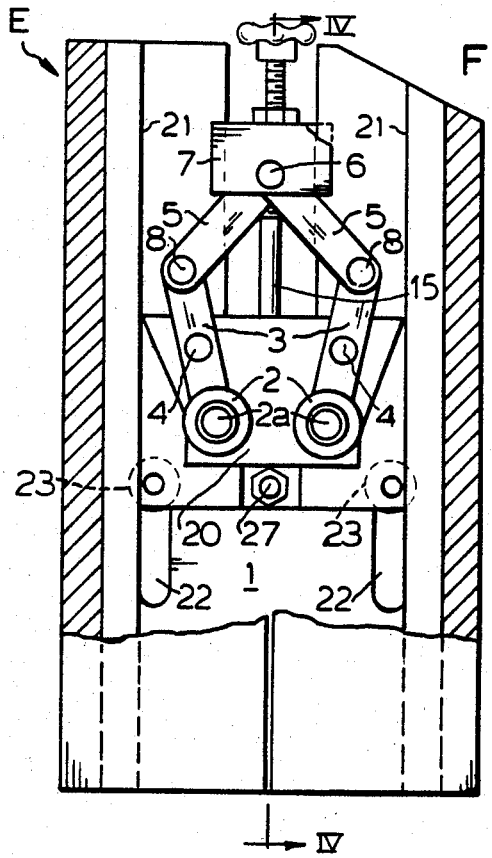
FIG. 2 is a front elevational view, partially broken away and in section, showing a slider-position-controlling device embodying the invention.
Figure 5:
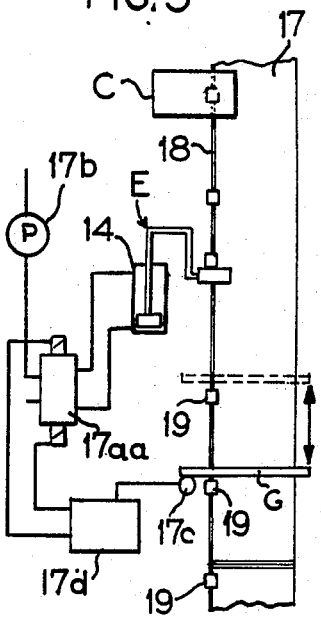
FIG. 5 is a schematic view showing a preferred arrangement for controlling operation of the slider-position-controlling device.
Figure 4:
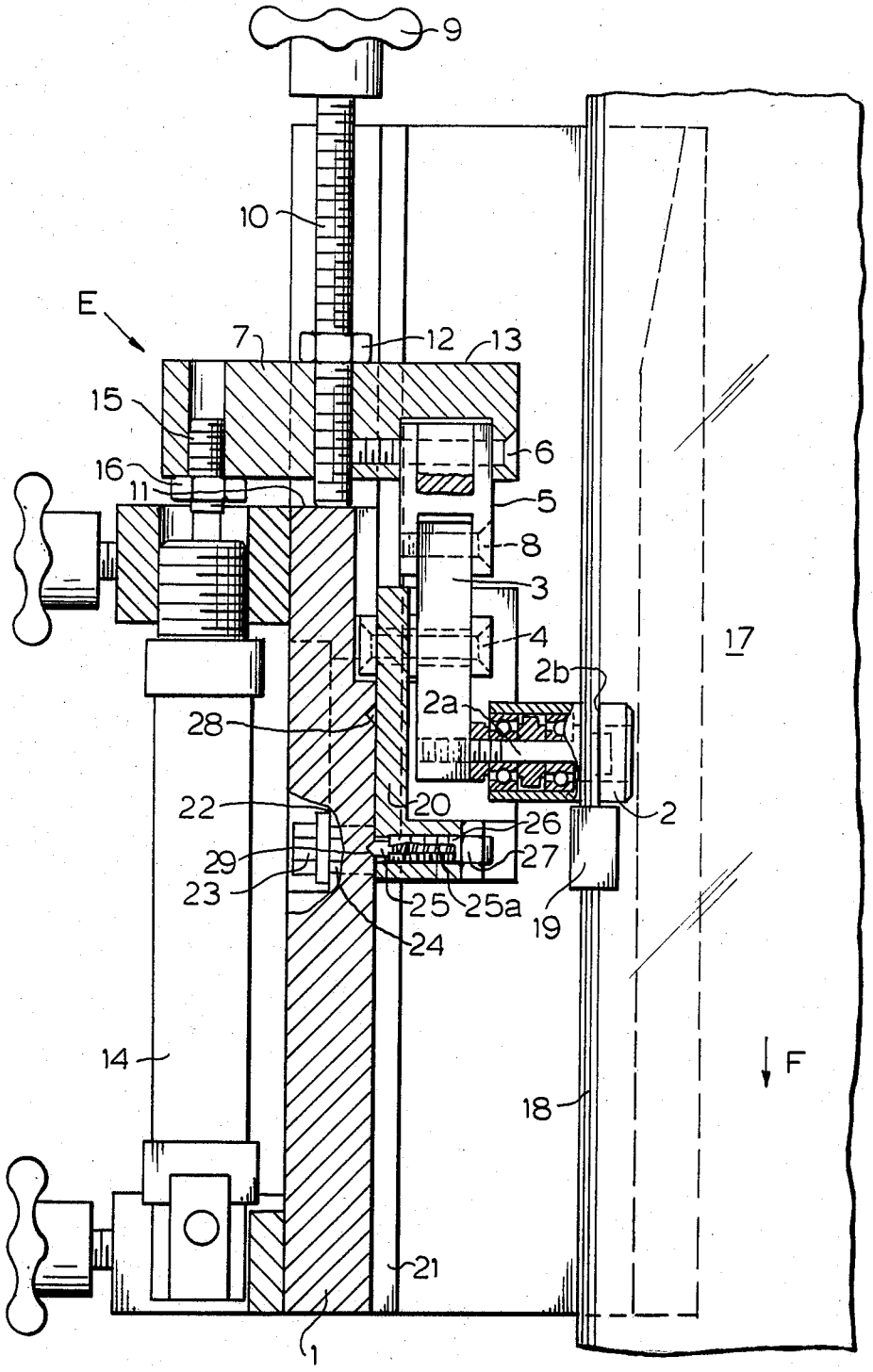
FIG. 4 is an enlarged vertical sectional detail view taken substantially along the line IV—IV in FIG. 2.

On reference to FIGS. 1 and 2, the device E has a frame 1 which supports two rollers 2 providing between them a passage for the profile zipper means 18. These rollers 2 are rotatable about shafts 2*a* and have zipper profile means accommodating grooves 2*b* (FIG. 4). Each of the rollers 2 is mounted at the free end of an arm 3 intermediately pivotally mounted for swinging about a shaft 4. At their other ends, the arms 3 are pivotably connected to respective links 5 which converge to and are connected to a common shaft 6 carried by a vertically movable support head 7. Pivots 8 connect the arms 3 with the links 5 in an articulated manner.

The head 7 is adapted for guided vertical movement relative to the frame 1 and its bottoming position is adapted to be adjusted relative to the frame by means of a knob 9 on an adjustment screw 10 which thrusts as a stop against a shoulder 11 provided by the frame 1. A locknut 12 is adapted for locking the screw 10 in adjusted position relative to the support 7 by screwing it tightly against a top surface 13 on the head 7.

Vertical actuation of the head 7 for controlling pivoting of the links 5 and the lever arms 3, and thereby effecting opening and closing of the rollers 2, is adapted to be effected by means of a pneumatic actuator 14 which is mounted in stationary relation at the back of the frame 1 and has a threaded piston rod 15 secured to the underside of the rear portion of the head 7 and is locked thereto by means of a lock nut 16. Automatic control of the actuator 14 is adapted to be effected by any suitable means, in known manner, such as electro valve means 17*aa* for controlling compressed air source 17*b*, suitable detector means 17*c* for signaling a controller 17*d*, and the like, all in and of themselves functioning in conventional manner, but in cyclical relation to the step by step advancement and stopping of the plastic sheet material 17 and the zipper means 18, the advancing direction being indicatd by the directional arrow F in FIG. 4.

With respect to the pivoting or articulating shafts 4, they are secured to a carriage 20 mounted slidably on the frame 1 between slideway guides 21. Retention of the carriage 20 in the slideway is effected by means of two longitudinally extending guide grooves and slots 22 in the frame 1 and through which headed screws 23 secured in the back of the carriage 20 are slidably engaged.

Means for indexing the carriage 20 in vertical operating positions in the slideway 21 is adapted to be effected by a rounded extremity of a detent plunger 25 urged as by means of a biasing spring 25*a* within a hollow bolt 26 secured in the carriage and locked in adjusted position as by means of a lock nut 27. The detent 25 is adapted to engage in either of two spaced detent sockets 28 and 29 located on the frame 1 behind the carriage 20.

In operation of the device E, when a slider 19 has arrived in position to be shiftably oriented on the zipper, the actuator 14 will have been controlled at the beginning of the cycle so that its piston rod has been retracted to the maximum extent permitted by the adjustment screw 10. At this phase in the oepration of the device, the head 7 will be in its lowermost adjusted position and the detent 25 will occupy the detent socket 29. At this time the slider 19 to be adjusted will be in the relationship to the rollers 2 depicted at $2_1$ (FIG. 3), and the previously positionally adjusted slider 19 will have moved downstream from the rollers 2 with the zipper 18.

Furthermore, downward displacement of the head 7 which has caused the rollers 2 to be moved toward one another, will by virtue of the stopping of the carriage 20 by engagement of the detent 25 in the socket 29 maintain the links 5 pivoted away from one another and the arms 3 and the rollers 2 rocked toward one another. Thereby the rollers 2 will be in their $2_1$ position and serve as barriers to hold the slider 19 upstream therefrom against advancing with the sheet material 17 and the zipper 18. As the bag making material moves in the direction of the arrow F, the slider 19 which is next in order to be shifted is moved from the position at which it was applied to the zipper 18 to a position, as controlled by the rollers 2, wherein the slider 19 is located in proximity to but downwardly spaced from the upstream portion of the zipper 18 where the next bag side sealing and separation line 17*a* is to be made by the sealing and advancing means G.

Figure 3:
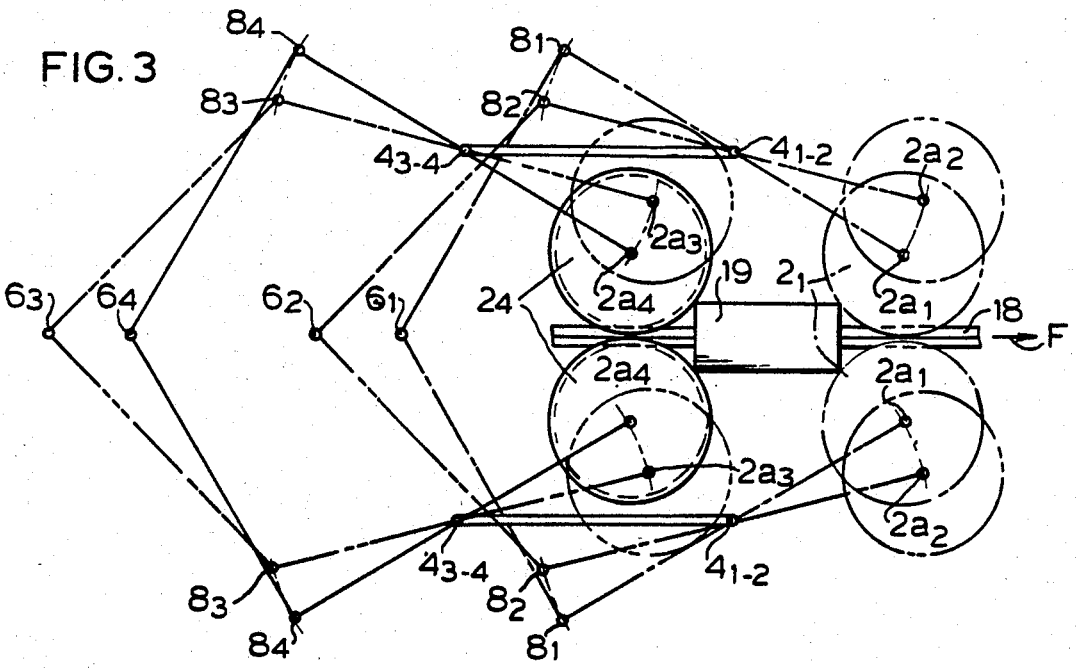
FIG. 3 is a schematic illustration showing the kinematics of the slider controlling rollers of the device.

Referring to FIG. 3, the rollers and the different axes of the system are, together with their operating mechanism assign subscripts for the various positions. At the moment that the closed rollers 2 have shifted the slider 19 to the desired position along the fastener 18, and which position is indicated in FIG. 3 by the designation $2_1$ and corresponding subscripted other reference characters, and which may be considered the second phase in the operating cycle, forward movement of the bag making sheet material reaches a momentary dwell. The actuator 14 then operates to separate and raise the head 7 from the frame 1 and the linkage and lever operating mechanism for the rollers 2 is caused to shift from the subscript 1 positions of the various components to the subscript 2 positions. In the fully open position, the axles 2*a* of the rollers are shifted from the $2a_1$ to the $2a_2$ position. Then, when the rollers 2 are fully open to the subscript 2 position, as in the positions thereof shown in FIG. 2, continuation of operation of the actuator 14 causes upward displacement of the carriage 20, and the detent 25 leaves the detent socket 29 and travels to and engages in the detent socket 28.

In the third phase or stage in the operation the rollers 2 and the mechanisms associated with operation of the rollers 2, they reach the orientations indicated by the subscripts 3 wherein the rollers 2 are now behind, that is upstream from the positioned slider 19. Thereupon, the acutator 14 is caused to reverse itself and this effects downward movement of the head 7 and actuation of the roller operating mechanism to the subscript 4 orientation which closes the rollers 2 toward one another at the upstream side of but in engagement with the slider 19. As the forward, that is downward displacement of the carriage 20 continues with the rollers 2 closed, and the bag making material 17, 18 still in the dwell phase, the rollers 2 slightly displace the slider a short distance in reverse, that is forwardly or downwardly on the profiled fastener zipper 18, causing the slider to zip a short length of the zipper 18 closed. This is advantageous in effecting a testing of the proper operation of the slider 19. There is thus provided a simple and rapid test procedure for detecting defective sliders. It will be apparent, also, that this procedure assures a sufficient length of the zipper profile section 18 upstream from the positioned slider 19 so as to leave ample space for the next succeeding transverse bag side seal 17*a* which will be made on the affected bag section, and which will provide, together with the associated downstream seal 17*a* stops for the slider 19 on the bag section. After the operations of the rollers 2 as just described, onward travel is resumed of the bag materials 17, 18, and the cycle is repeated. That is, the actuator 14 continues driving the head 7 downwardly. The detent means 25 leaves the socket 28 and the rollers 2, still in the subscript 4 position, travel down with the onward travelling bag material until the detent 25 again engages in the socket 29, and the rollers reach the subscript 1 position where the rollers will function to adjust the next succeeding slider 19.

If the zipper 18 is to be closed on the bag sections, then the rollers 2 are adjusted to close the zipper which, for the application of the sliders 19 thereto is open upstream from the device E. However, if it is desired to leave the zipper open, then the rollers 2 are adjusted to avoid closing of the zipper in any phase of the cycle except for the short upstream section of the zipper where the reverse movement testing of the slider 19 takes place. Adjustments for either of these alternatives, that is open zipper or closed zipper, are adapted to be effected by means of the knob 9 and the adjustment screw 10.

From the foregoing it is apparent that the present invention provides for obtaining open or closed bags, having regard to the zipper, of variable widths, without it being necessary to modify the distance which separates the slider applying means C relative to the sealing and advancing means G, and the sliders which have been tested for proper functioning are always located at a predetermined distance from the upstream extremity of the section of the zipper 18 for any particular bag.

It will be understood that variations and modifications may be effected without departing from the spirit and scope of the novel concepts of this invention.

We claim as our invention:

1. A device for controlling the position of sliders on a resiliently flexible bag closing zipper on bag making material travelling along a manufacturing path wherein the sliders are selectively applied to the zipper at bag width sections of the material upstream from a sealing station wherein sides of the bag width sections are sealed, comprising:

a frame providing a passsage for the zippers as carried on the bag making material and to which the sliders have been applied to said zipper at the bag width sections of the material upstream from the device;

roller means and means for operating the roller means for selective engagement of the sliders by said roller means;

said roller means and said operating means being carried by said frame and said operating means being operable for moving said roller means away from one another for permitting a slider mounted on the zipper of the bag making material to pass therebetween; and said operating means effecting movement of the roller means selectively toward one another into position adjacent to one another for engaging the slider for adjusting the slider position along the zipper in the travel of the bag making material along said path whereby to position the zipper to avoid interference with sealing of sides of said bag width sections in said sealing station.

2. Apparatus according to claim 1, wherein said roller means comprise two opposed rollers mounted at the free ends of respective pivotable arms comprising part of said operating means, and means pivotably mounting said arms and operable for actuating said arms for spreading the rollers apart from one another for free passage of a slider mounted on the zipper and for bringing the rollers cyclically together for restraining movement of the next succeeding slider mounted on the zipper as the bag making material advances, said rollers thereby effecting longitudinal displacement of the slider within a predetermined range on the zipper.

3. Apparatus according to claim 2, wherein said pivotable arms are connected in articulated fashion to respective links, and the links are connected to a common pivot mounted on head means operatively connected to actuating means for automatically actuating said head means in accordance with the advancing and dwelling travel of the bag making material.

4. Apparatus according to claim 3, wherein the maximum movement of the rollers toward one another is determined by ajustable stop means in part on said head means and in part on said frame.

5. Apparatus according to claim 4, wherein said adjustable stop comprises an adjustable screw carried by said head means and the screw being adjustably engageable at one end with a shoulder on the frame, and the opposite extremity of the screw has a manipulatable knob.

6. Apparatus according to claim 2, wherein said means pivotly mounting said pivotable arms comprises a carriage carrying pivot means for effecting said mounting of the arms, and means for slidably guiding the carriage reciprocatingly on said frame.

7. Apparatus according to claim 6, including biased detent means for indexing said carriage in longitudinally spaced positions on the frame.

8. Apparatus according to claim 7, wherein said detent means comprise detent element mounted in yieldably biased relation by a hollow bolt carried by said carriage.

9. A device according to claim 1, wherein said operating means comprise pivotal arms and means mounting said roller means on free ends of said arms, a reciprocatable carriage, means intermediately pivotally mounting said arms on said carriage, links connected to opposite ends of said arms, a reciprocatable head, means pivotally connecting said links to said head, means for actuating said head cyclically, and means for controlling said head and said carriage.

10. A device according to claim 9, including means for controlling the extent of movement of said rollers toward one another.

11. A device according to claim 10, wherein said controlling means comprises an adjustable stop including a stop screw carried by said head and engageable with a shoulder on said frame, and means for adjusting said stop screw.

12. A device according to claim 9, including releasable detent means for selectively retaining said carriage in two different longitudinally spaced positions on said frame in the operation of said operating means.

13. A method of controlling the position of sliders on a resiliently flexible bag closing zipper on bag making material travelling along a manufacturing path wherein the sliders are selectively applied to the zipper at bag width sections of the material, comprising:

after the sliders have been applied to said zipper at the bag width sections of the material, selectively engaging the sliders with roller means and thereby longitudinally repositioning the sliders along said bag width sections in proper location to avoid interference with sealing of sides of bag width sections of the material.

14. A method according to claim 13, which includes operating said roller means for not only effecting said repositioning of the sliders but also for closing said zipper.

15. A method according to claim 13, which comprises operating said roller means for moving said sliders in two opposite directions on said zipper, and thereby not only repositioning the sliders but also determining proper functioning of the sliders.

16. A method according to claim 13, which comprises after said repositioning of said sliders, and leaving the zipper open throughout a substantial length of each bag section portion of the zipper.

* * * * *